United States Patent [19]

Thompson

[11] Patent Number: 4,556,820

[45] Date of Patent: Dec. 3, 1985

[54] IMAGE DISPLAY INCLUDING A LIGHT-ABSORBING MATRIX OF ZINC-IRON SULFIDE

[75] Inventor: Robert P. Thompson, Millersville, Pa.

[73] Assignee: RCA Corporation, Princeton, N.J.

[21] Appl. No.: 565,284

[22] Filed: Dec. 27, 1983

[51] Int. Cl.[4] ..... H01J 29/28

[52] U.S. Cl. ..... 313/470

[58] Field of Search ..... 313/470–473; 427/68, 64; 430/25, 28, 29

[56] References Cited

U.S. PATENT DOCUMENTS

| | | | |
|---|---|---|---|
| 3,558,310 | 1/1971 | Mayaud | 96/36.1 |
| 3,952,225 | 4/1976 | Dietch | 313/472 |
| 4,049,452 | 9/1977 | Nekut | 96/36.1 |
| 4,066,924 | 3/1978 | Rublack | 313/470 X |
| 4,217,520 | 8/1980 | Sugarman | 313/472 |
| 4,263,385 | 4/1981 | Pampalone | 430/25 |
| 4,263,386 | 4/1981 | Datta et al. | 430/25 |
| 4,273,842 | 6/1981 | Nonogaki et al. | 430/25 |
| 4,324,850 | 4/1982 | Tomita et al. | 430/24 |

*Primary Examiner*—Palmer C. DeMeo
*Assistant Examiner*—Sandra L. O'Shea
*Attorney, Agent, or Firm*—Eugene M. Whitacre; Dennis H. Irlbeck; LeRoy Greenspan

[57] ABSTRACT

Image display including a viewing screen comprising spaced elemental image areas and a light-absorbing matrix of crystalline zinc-iron sulfide particles adjacent to these areas. The display may be made by producing a layer which is tacky in substantially the pattern of the desired matrix, and then contacting crystalline zinc-iron sulfide particles with the tacky pattern, whereby particles adhere to the tacky pattern, thereby producing the desired matrix.

7 Claims, 3 Drawing Figures

IMAGE DISPLAY INCLUDING A LIGHT-ABSORBING MATRIX OF ZINC-IRON SULFIDE

BACKGROUND OF THE INVENTION

This invention relates to a novel image display comprising a light-absorbing matrix and to a novel method for making that matrix. The novel image display may be a CRT (cathode-ray tube) intended for the display of television images, data or other types of information processed by an electronic system.

The viewing screen of an image display, such as a CRT of the aperture-mask type, comprises spaced elemental picture areas of luminescent material that are individually excited to luminescence. One expedient, used to improve the contrast of the luminescent image that is produced on the screen, is a light-absorbing or black matrix adjacent to the elemental areas of the picture. Such matrix has the effect of substantially reducing the intensity of ambient light that is reflected from the spaces between the elemental areas of the image.

Image displays including a light-absorbing matrix, methods for preparing a matrix, and materials constituting a matrix are disclosed previously, for example, in U.S. Pat. Nos. 3,558,310 to E. E. Mayaud and 4,049,452 to E. E. Nekut. One general method for preparing a light-absorbing matrix employs an intermediate tacky pattern. Variations of this general method are disclosed, for example, in U.S. Pat. Nos. 4,263,385 to T. R. Pampalone, 4,263,386 to P. Datta et al., 4,273,842 to S. Nonogaki et al. and 4,324,850 to Y. Tomita et al. In that general method, a layer of phototackifiable material is exposed to actinic light substantially in the pattern of the desired matrix, so that the exposed areas of the layer become tacky. Then, powdered matrix material is applied to the layer and the excess material is removed, leaving particles of matrix material attached to the tacky areas of the layer. Areas of luminescent materials of each of three different emission colors may be deposited by a similar procedure before the matrix is prepared.

Obviously, the matrix material should be strongly light-absorbing, strongly attractive to the tacky areas of the layer, and weakly attractive or even repulsive to the other areas of the layer. Also, the matrix material should be resistant to baking in air at elevated temperatures and to other subsequent fabrication procedures, and should be held in place after the tacky material is removed by subsequent baking.

Of all the matrix materials suggested in the prior art, graphite and carbon have been the most used and the most successful. That use has been principally with processes disclosed in the above-cited patents to Mayaud and Nekut. It is desirable to provide a matrix material which is better adapted for deposition on a tacky pattern. Such a material can improve both the method of preparing the matrix and the product of that method.

SUMMARY OF THE INVENTION

In the novel image display and the method of preparation thereof, the matrix material consists essentially of particulate zinc-iron sulfide having the molar composition $Zn_{1-x}Fe_xS$, wherein x=0.1 to 0.9. Thus, the novel image display includes a viewing screen comprising spaced elemental image areas and a light-absorbing matrix of zinc-iron sulfide particles adjacent to these areas. The novel method comprises producing a layer which is tacky in substantially the pattern of the desired matrix, and contacting crystalline zinc-iron sulfide particles with the tacky pattern, whereby particles adhere to the tacky pattern, thereby producing the desired matrix.

DETAILED DESCRIPTION OF THE INVENTION

The novel image display comprises a viewing window and a viewing screen attached to one surface of the window. The viewing screen includes spaced elemental image areas and a light-absorbing matrix consisting essentially of crystalline zinc-iron sulfide particles adjacent to the spaced elemental areas. The matrix may outline the elemental areas, or partially fill the space therebetween, or in the preferred form, completely fill the space between the elemental areas. Furthermore, the image display may be of any type wherein a viewing screen includes elemental image areas. Thus, the image display may employ liquid crystals, light-emitting diodes, electroluminescent layers, photoluminescent layers or cathodoluminescent layers.

Figure 1:
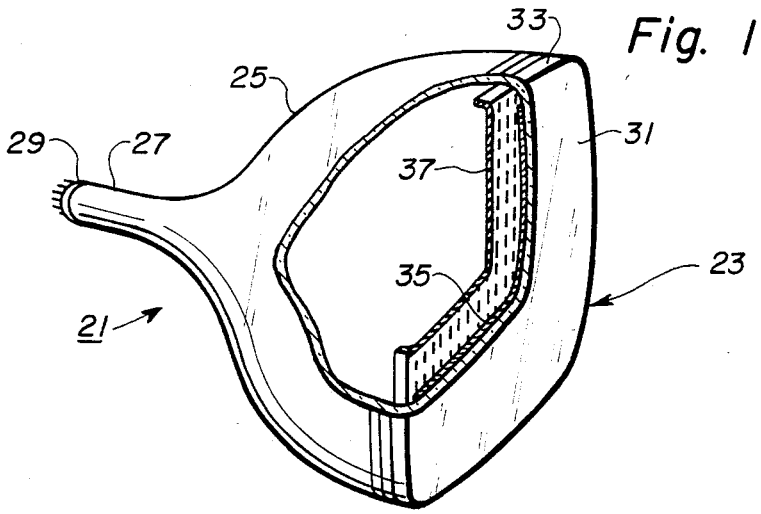
FIG. 1 is a partially-broken away perspective view of a CRT of the shadow-mask type constructed according to the invention.

The preferred form of the novel image display is a CRT of the shadow-mask type, a typical form of which is shown in FIG. 1. The CRT 21 shown in FIG. 1 includes a glass faceplate panel 23 hermetically sealed to the wide end of a glass funnel 25. The funnel has an integral neck 27 at its narrow end, which is closed by a stem 29. A multibeam electron gun (not shown) is attached to the stem 29 and is housed within the neck 27.

The faceplate panel 23 includes a viewing window 31 and a peripheral sidewall 33. A viewing screen 35 is supported on the inner surface of the window 31. An apertured shadow mask 37 is supported on the sidewall 33 in a closely-spaced relation with the viewing screen 35.

The viewing screen includes an ordered array of elemental image areas of cathodoluminescent phosphors of three different emission colors, which are generally red-emitting, green-emitting and blue-emitting. The elemental image areas may be dots in hexagonal array or vertical lines in parallel array, for example. A black, light-absorbing matrix fills the space between the elemental areas. The light-absorbing matrix consists essentially of crystalline zinc-iron sulfide. The novel image display may produce a single color or a multicolor image.

In its simplest form, the novel method consists essentially of producing a tacky pattern on a support surface, applying crystalline zinc-iron sulfide powder to the tacky pattern and removing any excess powder from the support surface. The powder sticks to the tacky pattern, thereby producing the light-absorbing matrix.

The active image material of the elemental image areas may be deposited before the matrix is produced.

The tacky pattern may be produced by any of the methods known in the art, including any of the methods mentioned in the above-cited patents to Datta et al, Nonogaki et al. and Tomita et al. For producing a viewing screen involving the deposition of a light-absorbing matrix and areas of one or more other active materials, it is preferred to use a phototackifiable layer and multiple exposures in order to produce two or more different tacky patterns sequentially.

The matrix material is zinc-iron sulfide having a molecular formula of $$Zn_{1-x}Fe_xS$$

wherein x may be in the range of 0.1 to 0.9. The preferred value of x is about 0.5. This material is crystalline, and has a cubic crystal structure similar to that of cubic zinc sulfide crystals. The matrix material may have an average particle size of about 1.0 to 20.0 microns. When the value of x is less than 0.1, the body color of the material is grayish and the deposition properties of the material are less absorptive. When the value of x is greater than 0.9, a greater amount of the matrix material tends to deposit randomly in nontacky areas.

Preparation of the matrix material has been accomplished by solid state reactions and by precipitation from soluble zinc and iron salts by the addition of ammonium sulfide. Particle size and crystal morphology can be controlled by firing variations and flux additions. Absorptivity can be altered by compositional changes. These matrix materials are process stable. Their handling or deposition characteristics can be altered by the application of coatings.

EXAMPLE NO. 1

Thoroughly mix 9.74 grams zinc sulfide, 7.99 grams iron oxide and 6.4 grams of sulfur. Place this mixture in a silica crucible and fire for one hour at about 930° C. in a reducing atmosphere. The product is a black crystalline material with an average particle size of about 10.9μ.

EXAMPLE NO. 2

Thoroughly mix 9.74 grams zinc sulfide, 7.99 grams iron oxide, 9.6 grams sulfur, and 0.014 gram ammonium iodide. Fire the mixture in a silica crucible in a reducing atmosphere for one hour at 900° C. The product has an average particle size of about 8.8μ.

EXAMPLE NO. 3

The formulation of Example No. 2 when fired at 1100° C. for one hour in a silica crucible yields a material with an average particle size of about 17.0μ.

EXAMPLE NO. 4

Intimately mix 117 grams of zinc sulfide, 383 grams of iron oxide and 288 grams of sulfur. Fire the mixture in a quartz beaker at 900° C. with a reducing atmosphere. Suspend 50 grams of the above-produced material in 350 ml. of deionized water. With constant stirring, add 1.5 ml. of a 0.5% potassium silicate solution. Stir for about 10 minutes. Add 2.8 ml. of a 5% zinc sulfate solution, and continue stirring for 15 minutes. Allow the suspension to settle; decant the clear liquid. Wash the solid product with one liter of deionized water. Dry the material at about 125° C. for four hours. Sieve through minus 200 mesh. The product is a zinc-silicate-coated zinc-iron sulfide. Ludox, zinc hydroxide, aluminum hydroxide and zirconyl phosphate coatings have been applied in a similar manner.

EXAMPLE NO. 5

Dissolve 14.38 grams of zinc sulfate heptahydrate and 13.90 grams of ferric sulfate heptahydrate in 500 ml. of deionized water. With constant stirring, introduce a 24% solution of ammonium sulfide. The precipitation is taken to a visible endpoint, after which the stirring is continued for about 30 minutes. The resultant black product is washed with deionized water and dried at about 125° C.

EXAMPLE NO. 6

Blend 293 grams zinc sulfide, 239 grams of iron oxide and 288 grams of sulfur. Place the mixture in a quartz beaker, and, under reducing conditions, fire for one hour at about 1050° C. The black crystalline reaction product has an average particle size of about 18.0μ and the composition $Zn_{0.5}Fe_{0.5}S$. Reflectivity measurements made on layers of this sample and a graphite standard indicate that the reflectivity of the zinc-iron sulfide layer is 4.4%, while a graphite layer is about 5.9%.

Figure 2:
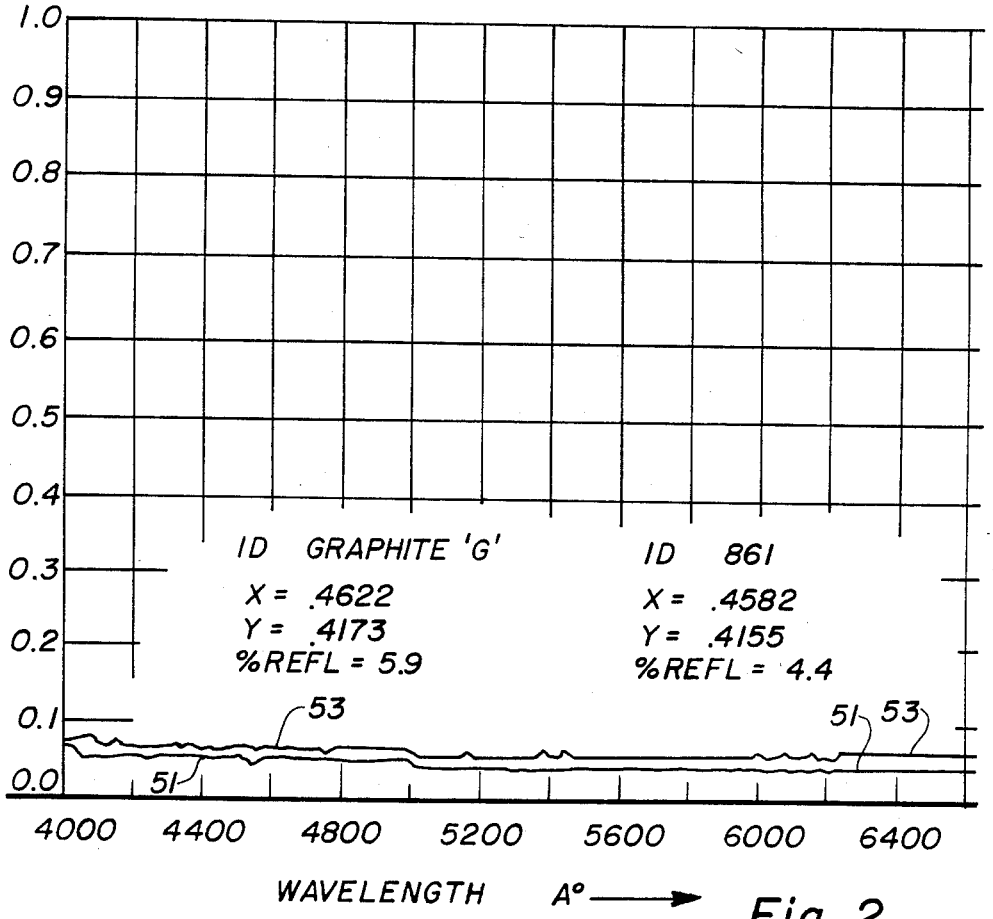
FIG. 2 is a pair of curves illustrating the reflectivity versus wavelength of a particular graphite and a preferred matrix material.

The curve 51 of FIG. 2 illustrates the blackness of a layer of matrix material prepared according to Example No. 6. The curve 53 illustrates the blackness of a layer of a typical graphite material used to prepare a black matrix for a commercial color television CRT. Packed dry layers of powders of the respective materials were prepared. Then, the reflection of a beam of white light from each layer was analyzed to yield percent reflectivity and CIE "x" and "y" coordinates. The tests show that layers of the $Zn_{0.5}Fe_{0.5}S$ material of Example No. 6 have a lower (4.4%) reflectivity than layers of the graphite material (5.9%). The CIE coordinates, though slightly different, indicate that both materials reflect an essentially neutral white light. A beam of light whose spectrum was about 50 A wide was scanned over the visible spectrum in the range of 4000 to 7000 A. The curves 51 and 53 show the percent reflectivity from this beam over the narrow spectral range for each of the layers.

Figure 3:
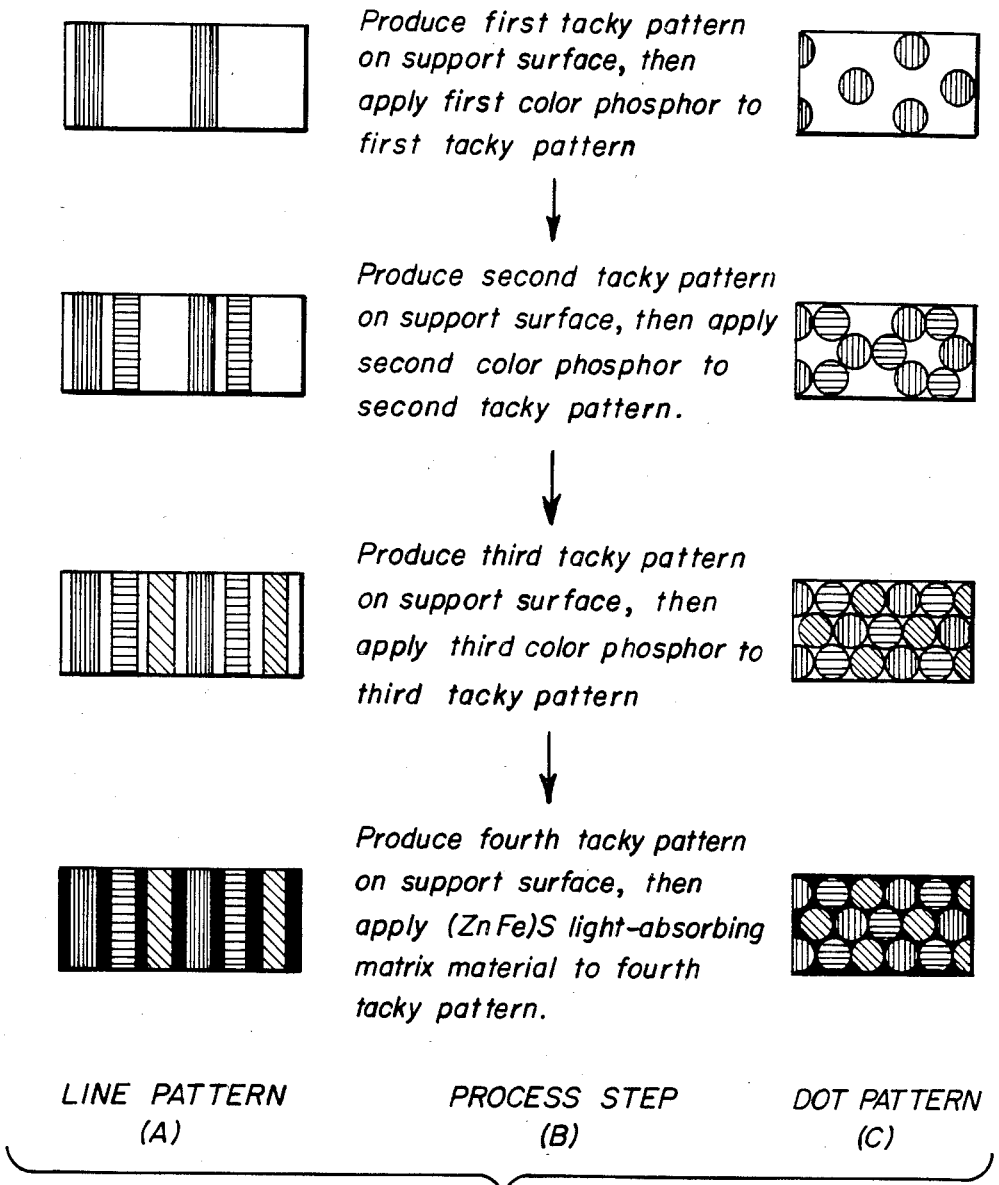
FIG. 3 is a flow diagram, with accompanying plan views of line-pattern and dot-pattern viewing screens during manufacture, showing various steps in practicing a preferred form of the novel method.

FIG. 3 herein illustrates the method using a phototackifiable material. Using the same steps shown in column B of FIG. 2, either a line pattern as shown in column A or a dot pattern as shown in column C can be prepared. The phosphor materials are green emitting, blue emitting and red emitting deposited in that order. The preferred green emitter is ZnCdS:Cu:Al; the preferred blue emitter is ZnS:Ag and the preferred red emitter is $(Y, Eu)_2O_2S$. The black matrix material $Zn_{0.5}Fe_{0.5}S$ has surface characteristics similar to those of the blue emitter and the green emitter.

What is claimed is:

1. An image display including a viewing screen comprising spaced elemental image areas and a light-absorbing matrix adjacent said spaced areas, said matrix consisting essentially of crystalline zinc-iron sulfide particles.

2. The display defined in claim 1 wherein said zinc-iron sulfide particles have a molar composition:

$$Zn_{1-x}Fe_xS$$

wherein x=0.1 to 0.9.

3. The display defined in claim 2 wherein said particles have the approximate molar composition:

$Zn_{0.5}Fe_{0.5}S$.

4. The display defined in claim 1 wherein a layer of said particles reflects about 4.4% of incident white light, and the reflected light has CIE coordinates of about x=0.458 and y=0.416.

5. The display defined in claim 1 wherein said viewing screen is attached to the inner surface of the viewing window of a multicolor cathode-ray tube, and each of said elemental image areas is filled with cathodoluminescent material.

6. The display defined in claim 5 wherein said tube is a color television picture tube and said elemental areas are ordered arrays of red-emitting, green-emitting and blue-emitting cathodoluminescent material.

7. The display defined in claim 6 wherein at least two of said cathodoluminescent materials have surface characteristics similar to those of pure zinc sulfide.

* * * * *